US009253845B2

(12) United States Patent
Davies

(10) Patent No.: US 9,253,845 B2
(45) Date of Patent: Feb. 2, 2016

(54) SYSTEMS AND METHODS FOR DATA COMMUNICATION FROM AN LED DEVICE TO THE DRIVER SYSTEM

(71) Applicant: TerraLUX, Inc., Longmont, CO (US)

(72) Inventor: Jeffrey Paul Davies, Louisville, CO (US)

(73) Assignee: TerraLUX, Inc., Longmont, CO (US)

( * ) Notice: Subject to any disclaimer, the term of this patent is extended or adjusted under 35 U.S.C. 154(b) by 101 days.

(21) Appl. No.: 13/714,795

(22) Filed: Dec. 14, 2012

(65) Prior Publication Data

US 2013/0154518 A1 Jun. 20, 2013

Related U.S. Application Data

(60) Provisional application No. 61/576,085, filed on Dec. 15, 2011.

(51) Int. Cl.
*H05B 37/02* (2006.01)
*H05B 33/08* (2006.01)

(52) U.S. Cl.
CPC ..... *H05B 33/0851* (2013.01); *H05B 33/089* (2013.01); *H05B 33/0854* (2013.01); *H05B 37/0263* (2013.01)

(58) Field of Classification Search
CPC ..... H05B 33/0815; H05B 33/0851; H05B 33/0854; H05B 33/0875; H05B 33/0881; H05B 33/0893; H05B 37/0236; H05B 41/2828; H05B 37/0272; H05B 33/0818; B69Q 11/00
USPC ..... 315/149, 224, 291, 294, 307–309, 312, 315/360; 323/285; 363/21.17
See application file for complete search history.

(56) References Cited

U.S. PATENT DOCUMENTS

| | | | | |
|---|---|---|---|---|
| 4,400,688 | A | 8/1983 | Johnston et al. | |
| 5,691,691 | A | 11/1997 | Merwin et al. | |
| 6,097,761 | A | 8/2000 | Buhring et al. | |
| 6,490,512 | B1 * | 12/2002 | Niggemann | 701/29.1 |
| 6,510,995 | B2 * | 1/2003 | Muthu et al. | 235/454 |
| 7,573,209 | B2 * | 8/2009 | Ashdown | H05B 33/0818 315/149 |
| 7,635,957 | B2 * | 12/2009 | Tripathi et al. | 315/309 |
| 8,040,078 | B1 | 10/2011 | Knoble et al. | |
| 8,120,283 | B2 | 2/2012 | Tanaka et al. | |
| 8,890,442 | B2 * | 11/2014 | Radermacher | H05B 33/0851 315/308 |
| 2005/0242822 | A1 | 11/2005 | Klinger | |
| 2006/0038661 | A1 | 2/2006 | Reinhold et al. | |
| 2006/0273741 | A1 | 12/2006 | Stalker, III | |

(Continued)

FOREIGN PATENT DOCUMENTS

| | | | |
|---|---|---|---|
| EP | 1000806 | A2 | 5/2000 |
| EP | 1731003 | A2 | 12/2006 |

(Continued)

OTHER PUBLICATIONS

International Application Serial No. PCT/US2012/069723, International Preliminary Report on Patentability mailed on Jun. 26, 2014, 8 pages.

(Continued)

*Primary Examiner* — Haissa Philogene
(74) *Attorney, Agent, or Firm* — Neugeboren O'Dowd PC

(57) ABSTRACT

One or more operating conditions of an LED device is sensed, and the sensed condition is communicated to an LED driver by modulating a load thereof.

14 Claims, 4 Drawing Sheets

(56) References Cited

U.S. PATENT DOCUMENTS

| | | | | |
|---|---|---|---|---|
| 2007/0236159 | A1 | 10/2007 | Beland | |
| 2009/0160627 | A1 | 6/2009 | Godbole | |
| 2010/0096993 | A1 | 4/2010 | Ashdown et al. | |
| 2011/0006696 | A1 | 1/2011 | Menegazzi et al. | |
| 2011/0248644 | A1 | 10/2011 | Welten et al. | |
| 2015/0048754 | A1* | 2/2015 | Davies et al. | 315/291 |

FOREIGN PATENT DOCUMENTS

| | | | |
|---|---|---|---|
| EP | 2330336 | A1 | 6/2011 |
| EP | 2375858 | A1 | 10/2011 |
| FR | 2953080 | A1 | 5/2011 |
| GB | 2335334 | A | 9/1999 |
| WO | 99/48340 | A1 | 9/1999 |
| WO | WO-2006062484 | A1 | 6/2006 |
| WO | WO-2008001274 | A2 | 1/2008 |
| WO | WO-2009022153 | A1 | 2/2009 |
| WO | 2013/090704 | A1 | 6/2013 |

OTHER PUBLICATIONS

International Search Report and Written Opinion mailed May 23, 2013 for International Application No. PCT/US2012/069723 (11 pages).

* cited by examiner

SYSTEMS AND METHODS FOR DATA COMMUNICATION FROM AN LED DEVICE TO THE DRIVER SYSTEM

CROSS-REFERENCE TO RELATED APPLICATION

This application claims priority to, and the benefits of, U.S. Provisional Application Ser. No. 61/576,085, filed on Dec. 15, 2011, the entire disclosure of which is hereby incorporated by reference.

FIELD OF THE INVENTION

The technology disclosed herein relates, in general, to light emitting diodes (LEDs) and, more specifically, to systems and methods that communicate data from one or more LEDs to an LED driver.

BACKGROUND

LEDs represent an attractive alternative to incandescent light bulbs in illumination devices due to their smaller form factor, lower energy consumption, longer operational lifetime, and enhanced mechanical robustness. To provide the aforementioned advantages, LEDs must be controlled and driven properly. In particular, in contrast to incandescent bulbs, the operating conditions (e.g., temperature) to which an LED is subjected used greatly affect the performance (e.g., luminous intensity) thereof. The operating conditions are controlled by an LED driver, typically by regulating the current flowing through the LEDs; the LED driver, however, is typically designed as general-purpose circuitry for use with a wide variety of LEDs. Accordingly, LEDs having different load characteristics may experience substantially varying operating conditions and performance despite using the same driver. In addition, because the input load characteristics of an LED do not remain constant over the LED's lifetime, but instead change with age and environmental conditions, the compatibility between an LED and its driver may erode over time, thereby causing unstable LED performance.

Conventionally, the load characteristics or operating conditions of LEDs are monitored by external circuitry that communicates the monitored information over an external data path to the LED driver. Upon detecting changes in the load characteristics or operating conditions of LEDs, for example, the external circuitry transmits a feedback signal to the LED driver to change the output load impedance or signal frequency to compensate for the changes. The external circuitry may involve, for example, a temperature-sensitive element (e.g., thermistor, thermocouple, etc.) positioned near the LEDs and a discrete data channel to communicate the sensed temperature. Such complex and specialized circuit designs can be expensive and inconveniently implemented, especially when the sensing system is far from the driver. Additionally, various schemes for communicating the LED performance information may interrupt normal operation of the LEDs.

Consequently, there is a need for circuitry that can reliably monitor the operating conditions of the LEDs without interrupting normal operation, vary the output of the LED driver to optimize the performance of the LEDs, and is conveniently deployed in a luminaire or other LED-based device.

SUMMARY

In various embodiments, the present invention relates to systems and methods for directly transmitting operating conditions affecting one or more LEDs to the LED driver via a small electronics package co-located with the LEDs. The electronics package may include a microcontroller to activate a component (e.g., a thermistor) that monitors one or more operating conditions (for example, the temperature) of the LEDs and then transmits the measured information to the electronics of the LED driver, preferably by modulating the driver load with circuitry (e.g., a transistor and a resistor) in a manner that conveys the information. The electronics package (or at least the sensing component thereof) is compact and located sufficiently proximate to the LED(s) to detect relevant operating conditions without interrupting normal LED operation.

Use of a simple and small electronics package allows the LED driver to selectively and directly monitor LED operating conditions and adjust the operating current/voltage to optimize LED performance and lifetime. The direct transmission of the information-containing signals by load modulation obviates the need for a dedicated communication channel between the LED(s) and the LED driver, and thus avoids using unnecessary circuitry to convey information; this simplifies the overall circuit design. Furthermore, communication by load modulation alters the LED load at a level sufficient for data detection by the LED driver but insufficient to be detected by the human eye, thereby imposing at most a negligible impact on normal LED operation.

Accordingly, in one aspect, the invention pertains to a system for communicating one or more operating conditions (e.g., temperature) of an LED device to an LED driver. In representative embodiments, the system includes sensing circuitry for sensing an operating condition affecting the LED device and communication circuitry for modulating a load of the LED driver based on the sensed operating condition, thereby communicating the sensed condition to the LED driver. The sensing circuitry may include a thermistor. In various embodiments, the communication circuitry includes a device for switching a load in and out of the LED driver load. The device may include a transistor and the load may include a resistor. In one implementation, the communication circuitry includes a controller for controlling the device based on data from the sensing circuitry.

In some embodiments, the communication circuitry is configured to modulate the load in a temporal pattern corresponding to a digital value that itself corresponds to the sensed operating condition. The temporal pattern may correspond to a bit rate, which may be faster than an activation rate of the sensing circuitry. In one embodiment, the communication circuitry further includes monitoring circuitry for monitoring an output waveform of the LED driver. The controller synchronizes the temporal pattern with a frequency of the output waveform.

In another aspect, the invention relates to a method for controlling an LED device connected to an LED driver. In various embodiments, the method includes sensing an operating condition of the LED device, modulating a load of the LED driver based on the sensed operating condition, and varying an output of the LED driver based on the modulated load. In one embodiment, the modulated load is detected by the LED driver, which responsively adjusts the output based thereon. In another embodiment, the load is modulated in a temporal pattern corresponding to a digital value that itself corresponds to the sensed operating condition. In various embodiments, the method further includes monitoring an output waveform of the LED driver and synchronizing the temporal pattern with a frequency of the monitored output waveform. The temporal pattern may correspond to a bit rate, which may be faster than a sensing rate of sensing the operating condition.

As used herein, the term "approximately" means±10°, and in some embodiments, ±5°. Reference throughout this specification to "one example," "an example," "one embodiment," or "an embodiment" means that a particular feature, structure, or characteristic described in connection with the example is included in at least one example of the present technology. Thus, the occurrences of the phrases "in one example," "in an example," "one embodiment," or "an embodiment" in various places throughout this specification are not necessarily all referring to the same example. Furthermore, the particular features, structures, routines, steps, or characteristics may be combined in any suitable manner in one or more examples of the technology. The headings provided herein are for convenience only and are not intended to limit or interpret the scope or meaning of the claimed technology.

BRIEF DESCRIPTION OF THE DRAWINGS

In the drawings, like reference characters generally refer to the same parts throughout the different views. Also, the drawings are not necessarily to scale, with an emphasis instead generally being placed upon illustrating the principles of the invention. In the following description, various embodiments of the present invention are described with reference to the following drawings, in which.

DETAILED DESCRIPTION

Figure 1:
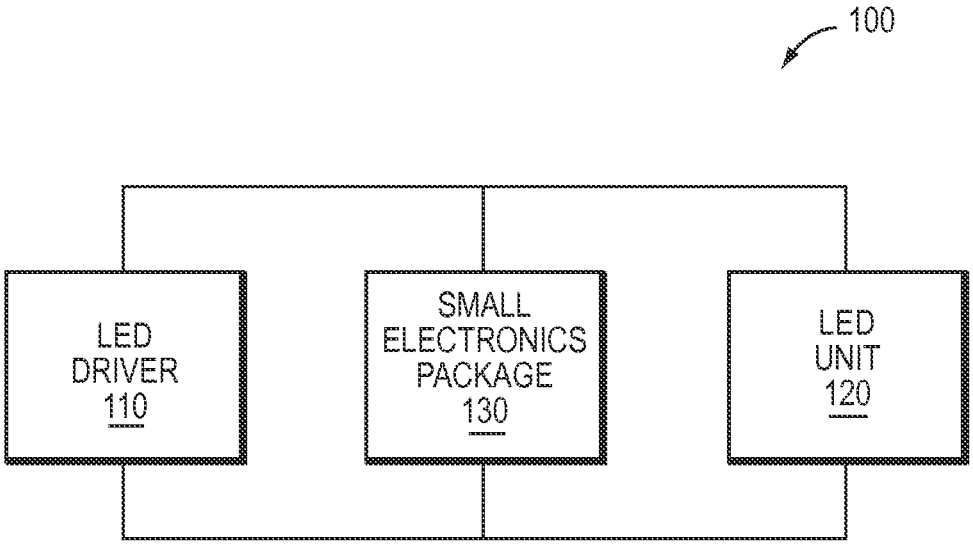
FIG. 1 schematically depicts circuitry of an LED lighting system in accordance with an embodiment of the present invention.

FIG. 1 illustrates an LED lighting system 100 that includes an LED driver 110 applying power to an LED unit 120 and a small electronics package 130 for communicating one or more relevant operating conditions (e.g., temperature) of the LED unit 120 to the LED driver 110. The LED unit 120 may include one or multiple LEDs electronically connected in parallel or in series and/or LED support circuitry. The LEDs may be, for example, solid-state LEDs, organic LEDs, polymer LEDs, phosphor coated LEDs, high-flux LEDs, or micro-LEDs. Each LED may be supplied with current by an independent LED driver 110, or a group of LEDs may share one LED driver 110. The LED driver 110 may be a constant-voltage source or a constant-current source, depending on the implementation, and includes at least one electronic component (e.g., an active device or a passive device) for providing a steady voltage or current to the LED unit 120. For example, a constant-voltage source may be DC batteries, which are capable of providing a sufficiently high DC voltage to turn on the LEDs, and a constant-current source may utilize a transistor or a resistor to provide a controlled current through the LED unit 120. In response to LED operating conditions, as measured and transmitted by the electronics package 130, the LED driver 110 may adjust the voltage or current supplied to the LED unit 120.

Figure 2A:
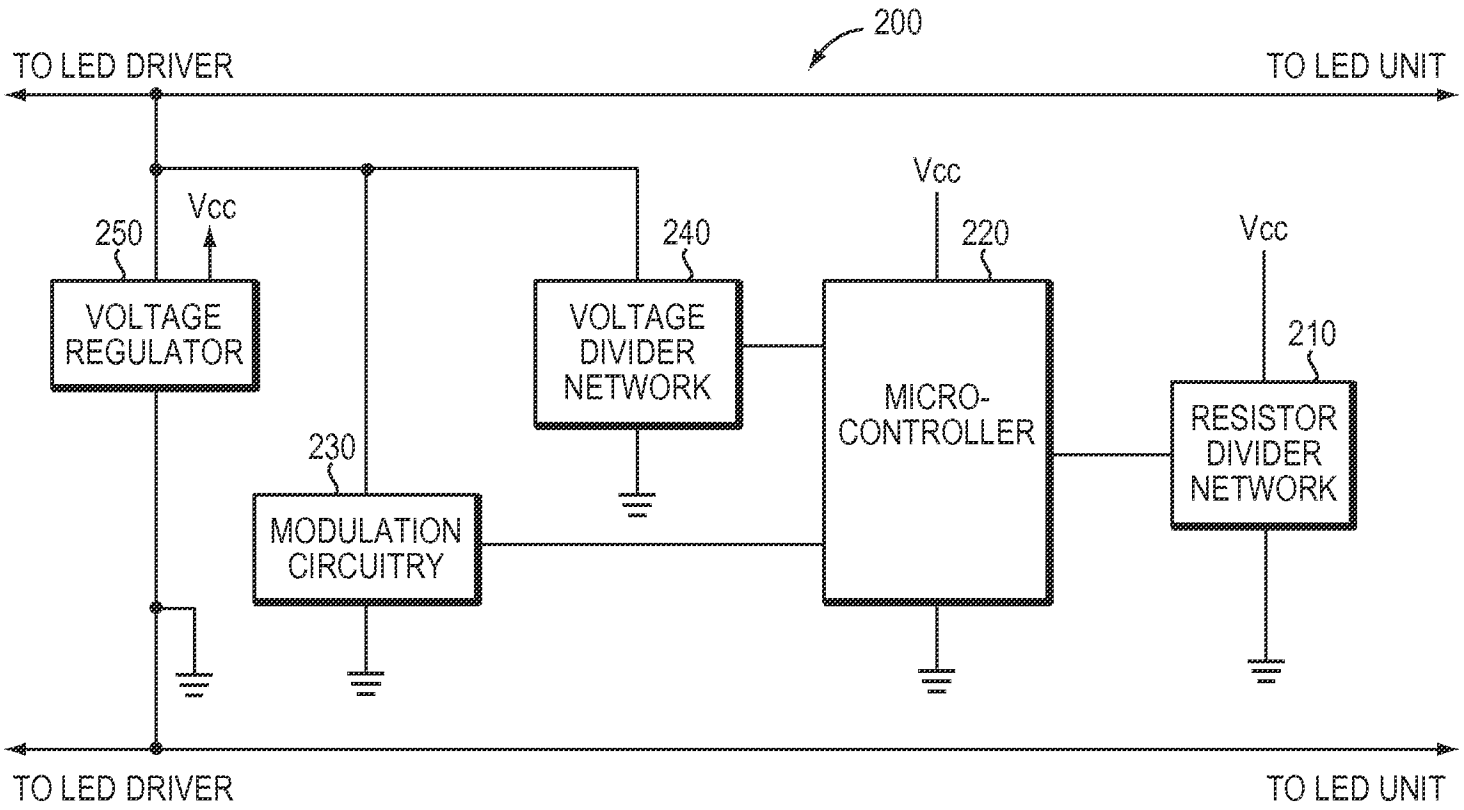
FIG. 2A is a schematic of a small electronics package in accordance with an embodiment of the invention.
Figure 2D:
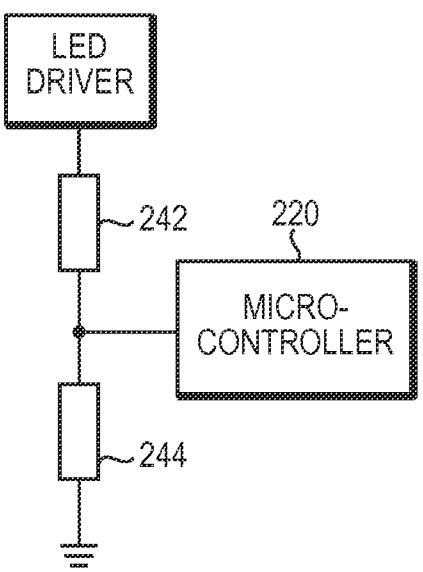
FIGS. 2B-2D depict schematics of various circuitry employed in the small electronics package in accordance with an embodiment of the invention.
Figure 2C:
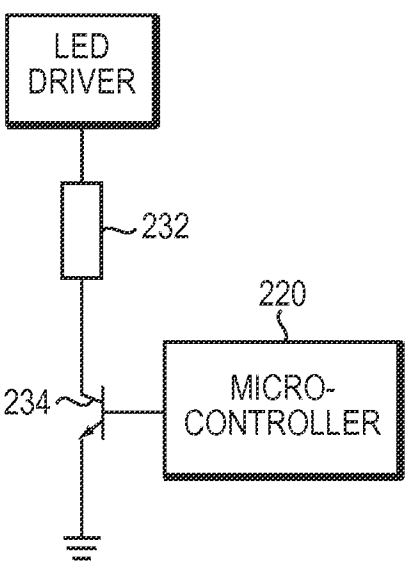
Figure 2B:
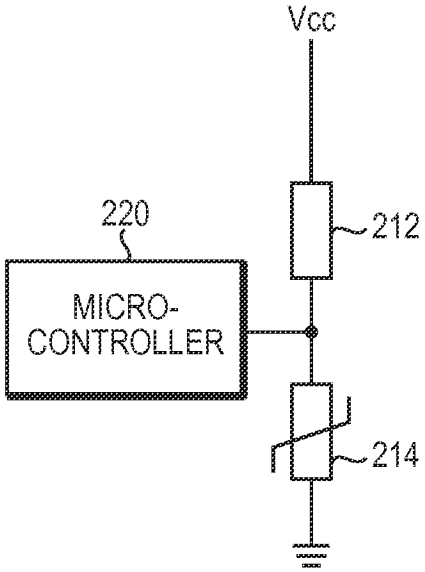

In various embodiments, the electronics package 130 is a single, compact unit that can be easily installed in and removed from the LED lighting system 100. Referring to FIG. 2A, in one embodiment, the small electronics package 200 includes a resistor divider network 210 to monitor the operating conditions (for example, the temperature) of the LED unit 120. As depicted in FIG. 2B, the resistor divider network 210 may include or consist essentially of, for example, a resistor 212 and a thermistor 214 or other device which can be used to measure the temperature or other operating condition(s) of the LED unit 120. Because the resistance of the thermistor 214 varies with the LED temperature and can be defined as $\Delta R = k\Delta T$, where $\Delta R$ and $\Delta T$ are changes in resistance and temperature, respectively, and k is the first-order temperature coefficient of resistance, the LED temperature can be monitored via constantly measuring the resistance of the thermistor 214. In one embodiment, a microcontroller 220 monitors the voltage developed across the thermistor 214, thereby determining the thermistor resistance.

Upon detecting the resistance of the thermistor 214, the microcontroller 220 computes the corresponding LED temperature and converts the detected temperature information into a signal that can be transmitted to the LED driver 110. For example, the measured temperature may first be converted to an 8-bit digital value. The microcontroller 220 then transmits this digital signal to the LED driver circuitry 110 by modulating the driver load with modulation circuitry 230. That is, the modulation circuitry 230 alters the driver load in a temporal pattern indicative of the digital value. This signal is sensed as a loading variation by the driver circuit 110 (see FIG. 1) and interpreted to recover the digital value. Based on this recovered value, the driver 110 alters the current and/or voltage supplied to the LED unit 120.

As a result, changes in the driver load communicated by the modulation circuitry 230 result in alteration of the operating current/voltage supplied to the LED unit in order to optimize the performance and lifetime of the LEDs. The modulation circuitry 230 may include, for example, a resistor 232 and a transistor 234 (or other switch), as depicted in FIG. 2C. The transistor 234 is turned on and off based on the digital temperature signal; this switches the resistor 232 in and out of the driver load circuitry and thus modulates the driver load on a bit-by-bit basis. Upon switching in the resistor 232 of the modulation circuitry 230, the resistance relative to the LED driver decreases, thus allowing the driving current to increase and creating a coincident drop in voltage at the LED unit 120. When the transistor 234 of the modulation circuitry 230 is turned off by the microcontroller 220, the driving current decreases due to the increased resistance, and the voltage across the LED unit returns to its normal operating value. Usually, a change of a few percent in the drive voltage can be detected by the driver electronics. Furthermore, the small change in the LED load due to the load modulation is preferably undetectable to the human eye, and thus typically represents a negligible effect on normal LED operation. For example, in one implementation, an average current of 120 mA flowing through the LED unit 120 fluctuates between 15 mA and 200 mA, corresponding to a voltage fluctuation between 42 V and 54 V during normal operation. Upon turning on the transistor 234 of the modulation circuitry 230, the current flowing through the transistor 234 increases to approximately 200 mA, corresponding approximately to a change of 1 V across the LED unit, for a duration of approximately 80 μs. This voltage change, i.e., 1 V, may be easily detected by the driver circuitry, but is undetectable by the human eye since it is only 2% of the normal LED operating voltage and is so brief (i.e., 80 μs).

In one embodiment, the microcontroller 220 monitors the output current waveform of the LED driver 110 using a voltage-divider network 240 and then synchronizes the data bit rate accordingly. For example, for a regular rectified output current waveform having a frequency of 120 Hz, the microcontroller 220 may transmit the measured temperature data with a bit rate of 120 Hz, thereby modulating the driver output waveform synchronously with each period (e.g., at the peak voltage). If the temperature data is represented by 8 bits, the data-transmission time is approximately 65 ms; the electronics package 220 thus ensures quick feedback to adjust the operating current/voltage of the LEDs in real time in response to changes in the operating conditions thereof. As shown in FIG. 2D, a suitable voltage divider network 240 can include or consist of a simple pair of resistors 242, 244. The voltage between these resistors 242, 244 can be monitored by the microcontroller 220 to facilitate transmitting temperature data bits synchronized to the periodic waveform of the LED current and voltage. Alternatively, the data bits may be sent asynchronously. Although the discussion herein focuses on an operating condition having an 8-bit digital signal for purposes of illustration, the present invention is not limited to any particular number of signal bits.

Furthermore, operating conditions other than temperature may be monitored. For example, the modulation circuitry 230 may be electrically responsive to another environmental condition (such as humidity or the degree of incident solar radiation) or an operating parameter of the LED(s), e.g., variations in the forward voltage, output wattage, lifetime operating hours, LED color temperature, or room occupancy detection. These conditions are measured and signals indicative of the measurements are communicated to the driver circuitry via modulation as described above.

In various embodiments, a voltage regulator 250 provides suitable power to the microcontroller 220. When the operating conditions of the LED unit 120 are not monitored or transmitting data to the LED driver 110 is not necessary, the microcontroller 220 may be deactivated to minimize power consumption. The microcontroller 220 may be provided as either software, hardware, or some combination thereof. Similarly, the driver circuitry contains circuitry to sense the loading modulations imparted by the modulation circuitry and suitable internal logic to decode the communication and take appropriate action, e.g., varying the supplied voltage and/or current. These functions may be implemented by computational circuitry including a main memory unit for storing programs and/or data relating to the activation or deactivation described above. The memory may include random access memory (RAM), read only memory (ROM), and/or FLASH memory residing on commonly available hardware such as one or more application specific integrated circuits (ASIC), field programmable gate arrays (FPGA), electrically erasable programmable read-only memories (EEPROM), programmable read-only memories (PROM), or programmable logic devices (PLD).

For embodiments in which the controller is provided as a software program, the program may be written in low-level microcode or in a high-level language such as FORTRAN, PASCAL, JAVA, C, C++, C#, LISP, PERL, BASIC, PYTHON or any suitable programming language.

Figure 3:
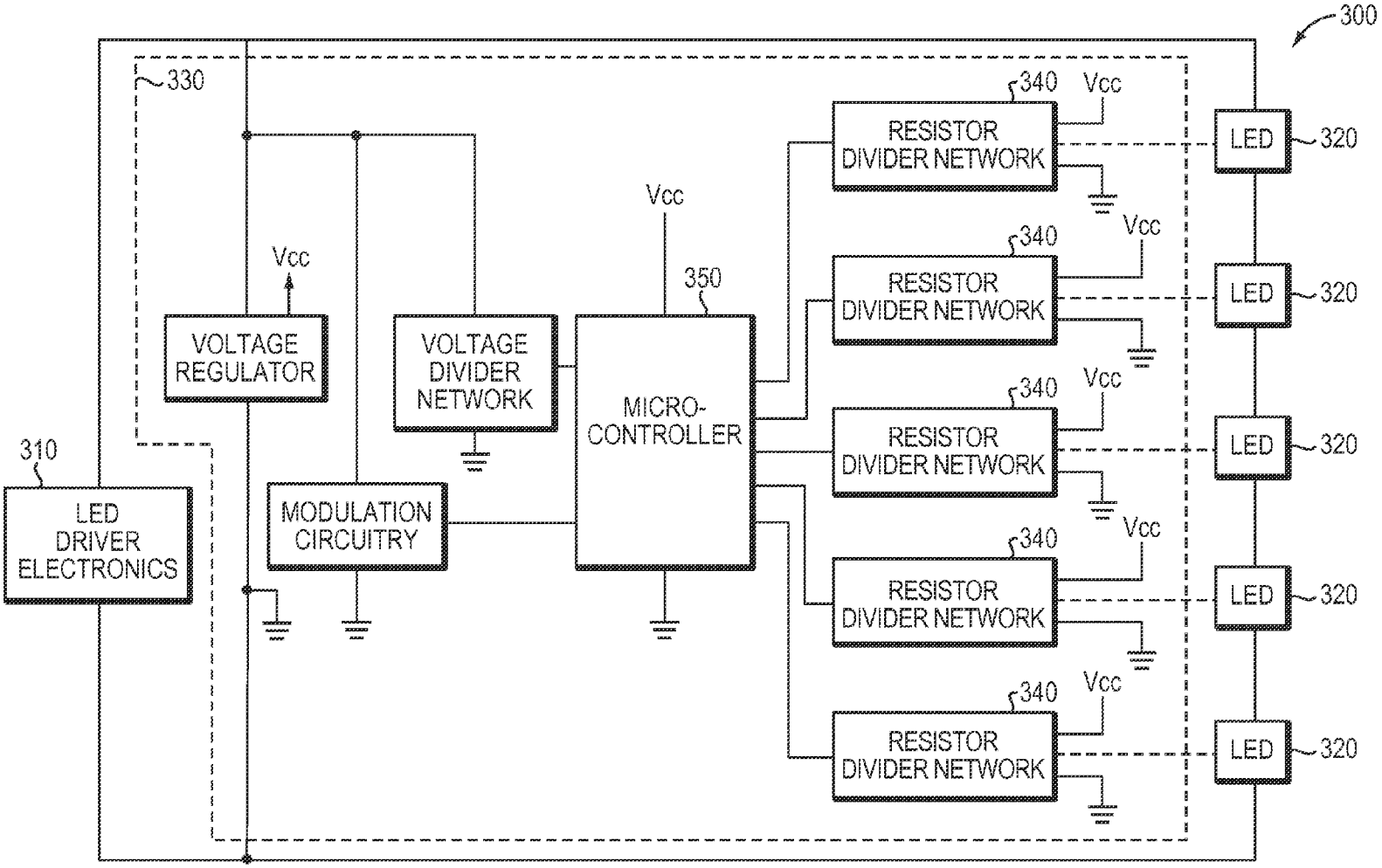
FIG. 3 is a schematic of an LED lighting system employing a small electronics package to monitor operating conditions of multiple LED units in accordance with an embodiment of the invention.

Referring to FIG. 3, in some embodiments, an LED lighting system 300 includes an LED driver 310 applying power to multiple LED units 320 and a small electronics package 330, which senses and measures at least one operating condition affecting each LED unit 320. The electronics package 330 may include multiple resistor divider networks 340, each monitoring an operating condition of one of the LED units 320. The monitored operating condition of each LED unit 320 may be the same or different. Upon receiving various operating conditions of the LED units 320, a microcontroller 350 in the electronics package 330 modulates the driver load, using the approach as described above, in order to communicate the sensed operating condition to the driver circuitry 310; the driver 310, in turn, modifies the drive signal applied to the LED units 320 in order to optimize their overall performance and lifetime.

In one embodiment, the microcontroller 350 transmits the operating-condition information of the LED units 320 at a low periodic rate (e.g., 0.1 Hz). Because the data transmission time from each LED unit 320 to the LED driver 310 is relatively short (e.g., 65 ms), the transmission of each LED unit 320 takes only approximately 0.6% of the time between transmissions. Accordingly, the likelihood of data interference between the multiple transmission lines of the LED units 320 is very low, thereby effectively avoiding data collisions in the LED driver electronics 310. In addition, when multiple devices are incorporated in the LED lighting system 300 and transmit various signals on the same drive channel, the low data update rate (e.g., every 10 seconds) advantageously minimizes a probability of data collisions in the driver electronics from the multiple devices.

In some embodiments, the measured information about the operating conditions (e.g., temperature) is converted to a data packet including a header sequence to establish the start of the data, a payload containing the digitized temperature data, and a trailer sequence to mark the end of the packet. The header sequence includes instructions about the temperature data carried by the packet; for example, the header sequence may include a board number or other identifiers to set up a data rate and/or a data size (e.g., 8-bit temperature value) and/or the synchronization of the bit rate with the frequency of the driver waveform. Additionally, the data packet may include a code (such as a checksum or cyclic redundancy check (CRC) value) in the trailer sequence to detect errors that are introduced into the data packet during transmission. For example, the microcontroller may detect bits having a value of "1" in the payload, sum up the total value thereof, and store the summation as a hexadecimal value in the trailer sequence. Upon receiving the data packet via modulation as described above, the LED driver electronics sums up the bits having a value of "1" in the payload and compares the results with the value stored in the trailer sequence. If the values match, it indicates that the temperature data in the payload is correct. If the values do not match, the receiving LED driver electronics ignores the corrupted data and waits for the next transmission cycle. Accordingly, the checksum or CRC value may reliably and effectively facilitate the identification of corrupted data or data with low signal-to-noise ratio (SNR) values.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. An LED system comprising:

an LED driver;

sensing circuitry for sensing an operating condition affecting an LED device; and communication circuitry for modulating a load of the LED driver based on the sensed operating condition, thereby communicating the sensed condition to the LED driver, wherein the communication circuitry is configured to modulate the load in a temporal pattern corresponding to a digital value that itself corresponds to the sensed operating condition, and the LED driver is configured to alter at least one of a current or a voltage supplied to the LED device based on the modulated driver load in order to optimize performance and lifetime thereof.

2. The system of claim 1, wherein the operating condition is temperature.

3. The system of claim 2, wherein the sensing circuitry comprises a thermistor.

4. The system of claim 1, wherein the communication circuitry comprises a device for switching a load in and out of the LED driver load.

5. The system of claim 4, wherein the device comprises a transistor.

6. The system of claim 4, wherein the load comprises a resistor.

7. The system of claim 4, wherein the communication circuitry comprises a controller for controlling the device based on data from the sensing circuitry.

8. The system of claim 1, wherein the communication circuitry further comprises monitoring circuitry for monitoring an output waveform of the LED driver.

9. The system of claim 1, wherein the temporal pattern corresponds to a bit rate, the bit rate being faster than a data update rate of the digital value corresponding to the operating condition sensed by activation of the sensing circuitry.

10. The system of claim 8, wherein the controller synchronizes the temporal pattern with a frequency of the output waveform.

11. A method for controlling an LED device connected to an LED driver, the method comprising:

sensing an operating condition of the LED device;

modulating a load of the LED driver based on the sensed operating condition; and varying at least one of a current or a voltage supplied from the LED driver to the LED device based on the modulated load in order to optimize performance and lifetime thereof, wherein the load is modulated in a temporal pattern corresponding to a digital value that itself corresponds to the sensed operating condition.

12. The method of claim 11, further comprising monitoring an output waveform of the LED driver and synchronizing the temporal pattern with a frequency of the monitored output waveform.

13. The method of claim 11, wherein the modulated load is detected by the LED driver, which responsively adjusts the output based thereon.

14. The method of claim 11, wherein the temporal pattern corresponds to a bit rate, the bit rate being faster than a data update rate of the digital value corresponding to the operating condition sensed by activation of sensing circuitry.

* * * * *